US005529194A

United States Patent [19]

Merker, Jr. et al.

[11] Patent Number: 5,529,194

[45] Date of Patent: * Jun. 25, 1996

[54] VARIABLE ANGLE FRICTION CLUTCH MECHANISM FOR A DRAFT GEAR ASSEMBLY

[75] Inventors: Walter H. Merker, Jr., Downersgrove; Howard R. Sommerfeld, Oak Forest, both of Ill.

[73] Assignee: Westinghouse Air Brake Company, Wilmerding, Pa.

[ * ] Notice: The term of this patent shall not extend beyond the expiration date of Pat. No. 5,443,170.

[21] Appl. No.: 393,282

[22] Filed: Feb. 23, 1995

Related U.S. Application Data

[62] Division of Ser. No. 183,838, Jan. 21, 1994, Pat. No. 5,443,170, which is a division of Ser. No. 3,109, Jan. 11, 1993, abandoned.

[51] Int. Cl.[6] ..... B61G 9/00

[52] U.S. Cl. ..... 213/32 C; 213/38

[58] Field of Search ..... 213/22, 23, 24, 213/31, 32 R, 32 A, 32 C, 34, 35, 36, 37, 38, 39

[56] References Cited

U.S. PATENT DOCUMENTS

| | | | |
|---|---|---|---|
| 1,931,480 | 10/1933 | Barrows . | |
| 2,141,680 | 12/1938 | Barrows | 213/39 |
| 2,233,348 | 2/1941 | Light | 213/39 |
| 2,481,575 | 9/1949 | Dath . | |
| 2,916,163 | 12/1959 | Campbell . | |
| 3,178,036 | 4/1965 | Cardwell . | |
| 3,447,693 | 6/1969 | Cardwell . | |
| 3,465,900 | 9/1969 | Cope et al. | 213/37 |
| 3,741,406 | 6/1973 | Anderson . | |
| 4,305,514 | 12/1981 | Zanow et al. . | |
| 4,576,295 | 3/1986 | Carlstedt . | |
| 4,645,187 | 2/1987 | Kanjo et al. . | |
| 4,735,328 | 4/1988 | Carlstedt . | |
| 4,809,419 | 3/1989 | Loonam . | |
| 4,960,215 | 10/1990 | Carlstedt . | |

FOREIGN PATENT DOCUMENTS

| | | | |
|---|---|---|---|
| 549573 | 12/1957 | Canada | 213/38 |

*Primary Examiner*—Mark T. Le
*Attorney, Agent, or Firm*—James O. Ray, Jr.

[57] ABSTRACT

A draft gear assembly having a variable angle friction clutch mechanism is provided. Such assembly includes a housing member having a compressible cushioning element disposed adjacent a closed end thereof. A seat is disposed between one end of the compressible cushioning element and an open end of the housing member. A friction cushioning assembly is positioned at least partially within the open end of the housing member and includes a plurality of friction surfaces disposed on a plurality of friction elements with at least one wedge member being engageable with the plurality of friction surfaces. At least one resilient member is provided to enable the friction cushioning mechanism to exhibit a variable angle. Such resilient member is engageable with at least one of the friction elements and exerts a lateral force on the friction cushioning mechanism which is at least sufficient to maintain all of the friction surfaces in frictional engagement during the useful life of the draft gear assembly.

9 Claims, 5 Drawing Sheets

VARIABLE ANGLE FRICTION CLUTCH MECHANISM FOR A DRAFT GEAR ASSEMBLY

This application is a divisional application of application Ser. No. 08/183,838, filed Jan. 21, 1994 now U.S. Pat. No. 5,443,170, which was a divisional application of application Ser. No. 08/003,109, filed Jan. 11, 1993, now abandoned.

FIELD OF THE INVENTION

The present invention relates, in general, to draft gear assemblies of the friction-type, which are used to cushion both buff and draft shocks normally encountered by railway rolling stock during make-up and/or operation of a train consist on a track structure and, more particularly, this invention relates to a friction-type draft gear assembly having a resilient member disposed in a predetermined position in the friction clutch mechanism of the draft gear assembly to exert a predetermined lateral force on at least one friction component and preferably disposed between an inner surface of the housing member and an adjacent surface of a friction component disposed next to such inner surface of the housing member to maintain the friction components substantially in frictional engagement even though such friction components may exhibit some degree of wear and to provide a variable angle between at least one wedge member and the wedge shoes during closure of such draft gear assembly thereby providing enhanced performance over the full range of travel of such draft gear assembly.

BACKGROUND OF THE INVENTION

In the railroad industry, draft gear assemblies of the friction-type have been in widespread use on rolling stock for many years. Such draft gear assemblies are used to absorb both the buff and draft shocks applied to the railroad rolling stock during normal operation. See, for example, U.S. Pat. Nos. 2,916,163; 3,178,036; 3,447,693; 4,576,295; 4,645,187 and 4,735,328 for a teaching of a number of draft gear assemblies which were in use in the railway industry prior to the present invention. Except for U.S. Pat. Nos. 4,576,295 and 4,735,328, each of the remaining above-identified patents is owned by the assignee of the present invention. The teachings of all of the above-identified prior art patents are incorporated into the present application by reference thereto.

It is well recognized, by persons skilled in the draft gear art, that these draft gear assemblies must maintain certain minimum shock absorbing capacity during in-track service. This minimum shock absorbing capacity is specified by the Association of American Railroads (AAR) Standards. For example, these draft gear assemblies have a specified capacity of at least 36,000 foot pounds. Further, it is important to note that the action of the friction clutch system enables this capacity to be accomplished without exceeding a 500,000 pound reaction pressure being exerted on the center sill member of a railway car during make-up and operation of a train consist. This maximum reaction pressure is required so that these high energy shocks can be readily handled without upsetting the shank of the coupling member and/or damaging other critical car components and cargo.

It is also well known that as wear of the friction clutch components occurs in these draft gear assemblies, efficiency of the draft gear assembly, during the initial application of a force being applied thereto, is diminished. Further, this wear of the friction clutch components generally results in a more non uniform operation of the draft gear assembly.

SUMMARY OF THE INVENTION

In a first aspect of the present invention there is a draft gear assembly provided which is used to cushion both the buff and draft shocks normally encountered in railroad rolling stock during make-up and operation of a train consist. This draft gear assembly includes a housing member which is closed at a first end thereof, and open at an opposed second end thereof. The housing member has a rear portion adjacent the closed first end and a front portion adjacent the opposed second open end. Such front portion is in open communication with the rear portion of the housing member. There is at least one compressible cushioning element disposed substantially centrally within the rear portion of such housing member. A first end of such compressible cushioning element is located adjacent at least a portion of an inner surface of the closed first end of the housing member. Such compressible cushioning element extends longitudinally from the closed first end toward the opposed second open end of the housing member. This compressible cushioning element absorbs a first portion of the energy generated during compression of such draft gear assembly. A seat means is provided which has at least a portion of one surface thereof, disposed adjacent an opposed second end of such compressible cushioning element. The seat means is mounted to move in a longitudinal direction within the housing member for, respectively, compressing and releasing the compressible cushioning element during an application and a release of a force being exerted on such draft gear assembly. A friction cushioning means is provided and is positioned at least partially within the opposed second open end of the housing member. This friction cushioning means absorbs a second portion of such energy generated during the compression of such draft gear assembly. This friction cushioning means includes a predetermined plurality of friction surfaces disposed on a predetermined plurality of friction elements and at least one wedge member which is engageable with at least a predetermined number of such plurality of friction surfaces. The final essential element of the draft gear assembly, in this embodiment of the present invention, is a resilient member engageable with at least one of such friction elements for exerting a lateral force on the friction cushioning means. Such lateral force is at least sufficient to maintain all of the plurality of friction surfaces in frictional engagement, even when a predetermined amount of wear may be exhibited by such plurality of friction elements. In this manner, energy will be dissipated throughout the entire travel of the friction cushioning means.

According to a second aspect, this invention provides an alternative draft gear assembly to cushion both buff and draft shocks encountered in railroad rolling stock during operation. In this embodiment, the draft gear assembly includes a housing member which is closed at a first end and open at an opposed second end thereof. This housing member has a rear portion adjacent the closed first end and a front portion adjacent the opposed second open end. Such front portion being in open communication with the rear portion of the housing member. There is at least one of a spring and a hydraulic compressible cushioning element centrally disposed within the rear portion of such housing member. A first end of the compressible cushioning element is disposed adjacent at least a portion of an inner surface of the closed first end of such housing member. Such compressible cushioning element extends longitudinally from the closed first end. This compressible cushioning element absorbs a first portion of the energy generated during compression of such draft gear assembly. The draft gear assembly has a seat means having at least a portion of one surface thereof disposed adjacent an opposed second end of the compressible cushioning element. Such seat means is mounted to move longitudinally within the housing member for, respectively, compressing and releasing the compressible cushioning element during an application and a release of a force on such draft gear assembly. A friction cushioning means is positioned at least partially within the front portion of such housing member for absorbing a second portion of the energy generated during a compression of the draft gear assembly. This friction cushioning means includes a pair of laterally spaced outer stationary plate members having an outer surface and a radially opposed inner friction surface. The outer surface of such stationary plate members is disposed adjacent an inner surface of such housing member. A pair of laterally spaced movable plate members of substantially uniform thickness also form a part of the friction cushioning means. Each movable plate member has an outer friction surface and an inner friction surface and at least one substantially flat edge disposed intermediate the outer friction surface and the inner friction surface. Such flat edge engages at least a portion of the seat means. Further, at least a portion of the outer friction surface of the movable plate members movably and frictionally engages a respective inner friction surface of the outer stationary plate member. There is a pair of laterally spaced tapered plate members having an outer friction surface and an inner friction surface. The outer friction surface of the tapered plate members movably and frictionally engages at least a portion of the inner friction surface of a respective movable plate member. In this embodiment, the friction cushioning means further includes a pair of laterally spaced wedge shoe members. Such wedge shoe members having at least a portion of an outer friction surface movably and frictionally engaging at least a portion of an inner friction surface of a respective tapered plate member. At least a portion of one edge of the wedge shoe member also engages the seat means. Such pair of wedge shoe members having a predetermined tapered portion that is tapered upwardly and outwardly from a plane that intersects a longitudinal centerline of the draft gear assembly at a predetermined angle. Another essential element of the friction cushioning means is a center wedge member which has a pair of matching predetermined tapered portions for engaging the tapered portion of a respective wedge shoe member. Such center wedge member initiates frictional engagement of such friction cushioning means and thereby enabling such second portion of the energy generated by buff and draft loads being exerted on the draft gear assembly to be absorbed. This draft gear assembly also has a spring release means which engages and extends longitudinally between the seat means and the center wedge member. The spring release means continuously urges the friction cushioning means outwardly from the compressible cushioning means to release the friction cushioning means when an applied force compressing the draft gear assembly is removed. The final essential element in this embodiment of the draft gear assembly is a resilient member engageable with at least one of the friction elements to exert a predetermined lateral force on such friction cushioning means which is at least sufficient to maintain all of the friction surfaces in frictional engagement when a predetermined amount of wear has occurred on the various friction elements.

In still another aspect of the present invention there is provided a draft gear mechanism used to cushion both buff and draft shocks. These buff and draft shocks are encountered during operation by railroad rolling stock. This draft gear mechanism has a centerline along its major axis and includes a hollow housing member having a generally tubular body portion with a first open end and a second closed end. A spring system is disposed within the hollow housing member adjacent the second closed end thereof. Such spring system includes an inner coil spring member, a middle coil spring member, an outer coil spring member and a plurality of corner coil spring members. A friction clutch means is disposed adjacent the first open end of the hollow housing member. This friction clutch means includes a friction plate member centrally disposed along the major axis. A first end of the friction plate member extends out of the hollow housing member and a second end is situated down in the first open end of the housing member. First and second barrier plate members are disposed one on either side of such friction plate member. Such first and second barrier plate members are anchored against longitudinal movement and they respond to lateral pressure. Such friction clutch means further includes first and second friction wedge members. The first friction wedge member is disposed on one side of such first barrier plate member and the second friction wedge member is disposed on one side of such second barrier plate member. Each of the first and second friction wedge members have first and second predetermined angles. The friction clutch means also has first and second friction shoe members. The first friction shoe member is disposed on one side of the-first friction wedge member and the second friction shoe member is disposed on one side of the second friction wedge member. Each of such first and second friction shoe members have first and second predetermined angles. First and second wear liner plate members are provided. Such first wear liner plate member is disposed on one side of the first friction shoe member and such second wear liner plate member is disposed on one side of the second friction shoe member. Such first and second wear liner plate members are anchored to the first open end of such hollow housing member in a manner to prevent longitudinal movement. The final element of the friction clutch means is a release wedge member having a horizontally extending body portion and having first and second predetermined angles which are cooperable with the second predetermined angle of such friction wedge member. A spring seat means is provided and has an aperture formed substantially centrally therethrough and an angled portion cooperating with second predetermined angle of such friction shoe member. The final essential element of this draft gear mechanism is at least one resilient member which is engageable with at least one of such friction elements for exerting a predetermined lateral force on the friction clutch means. This lateral force is at least sufficient to maintain all of such plurality of friction surfaces in frictional engagement even when a predetermined amount of wear has occurred to the plurality of friction elements.

In yet another aspect the present invention provides a friction type elastomer draft gear assembly. This draft gear assembly has a centerline along it's major axis and when such draft gear assembly is first tested it will generate impact forces below 500,000 pounds when seventy ton cars are impacted at speeds of at least 5 miles per hour. Such draft gear assembly will, after considerable energy input and wearing in of components will still generate impact forces below 500,000 pounds when impacted by seventy ton rail cars at speeds of at least 5 miles per hour when tested a second time. This friction type elastomer draft gear assembly includes a hollow housing member which has a generally tubular body portion that has an open end adjacent a first end thereof and a closed end adjacent an opposed second end thereof. A friction plate member is substantially centrally disposed along the major axis. A first end of this friction plate member extends outwardly from the open end of hollow housing member and a second end of the friction plate member is disposed within such open end of the hollow housing member. There are first and second barrier plate members disposed one on either side of the friction plate member. Such first and second barrier plate members are anchored against longitudinal movement but respond to lateral pressure. Additionally, first and second friction wedge members are provided in which the first friction wedge member is disposed on one side of the first barrier plate member and the second friction wedge member is disposed on one side of the second barrier plate member. Each of such first and second friction wedge members have first and second angled surfaces. This friction type elastomer draft gear assembly also includes first and second friction wedge shoe members. The first friction wedge shoe member is disposed on one side of the first friction wedge member and the second friction wedge shoe member is disposed on one side of the second friction wedge member. Each of such first and second friction wedge shoe members include first and second angled wedge surfaces. The first angled surface of the first friction wedge member cooperates with the first angled wedge surface of the first friction wedge shoe member to define a predetermined angle with respect to the center line. First and second wear liner plate members form a part of this friction type elastomer draft gear assembly. The first wear liner plate member being disposed on one side of the first friction wedge shoe member and the second wear liner plate member is disposed on one side of the second friction wedge shoe member. Such first and second wear plate liner members are anchored to the first open end of such hollow housing member against longitudinal movement. There is a release wedge member provided which has a horizontally extending body portion and angle portions. Such angle portions of the release wedge member cooperate with the second angled surface of such friction wedge member to define an angle with respect to the centerline. A spring seat member exerts a force against the friction wedge shoe members and includes angled portions which cooperate with the second angled surfaces of the friction wedge shoe members to define an angle with respect to the centerline. A spring system is disposed within the hollow housing member adjacent the second closed end thereof. This spring system includes a center coil spring member having a center void portion. Such center void portion is occupied by a first elastomer column spring. There is a series of corner coil spring members also having center void portions. Each of such center void portions of the corner coil spring members is occupied by a second elastomer column spring. The final essential element of this friction type elastomer draft gear assembly is at least one resilient member engageable with at least one of the friction members. Such resilient member exerts a predetermined lateral force on such friction members. This lateral force is at least sufficient to maintain all friction surfaces in frictional engagement even after a predetermined amount of wear has occurred to at least one of such friction members. In a further aspect, the present invention provides a railroad car coupler system draft gear assembly. This draft gear assembly includes a housing member having a hollow cast body divided into an inner section and an outer friction bore section. An elastomeric means is carried in the inner section of the housing member and absorbs a first portion of energy generated during closure of the draft gear assembly. An intermediate follower engages such elastomeric means and has an outer end which extends into the friction bore section of the housing member. A top and a pair of side friction shoe seats, each defined by pairs of inner surfaces of sidewalls of the friction bore section of the housing member and corners formed at a joinder of the pairs of such sidewall inner surfaces, are provided in the friction bore portion of the housing member. A grooved recess is formed as part of each such friction shoe seat. The grooved recess having an inner and outer groove portion positioned substantially perpendicular to a longitudinal axis of the housing member. A connecting groove portion joins such inner and outer groove portion and is positioned in proximate alignment with the seat corner. An insert having a rigid body is provided. Such insert is a bronze like material and is defined by a pair of elongated segments and a connecting segment joined thereto with one of each of such inserts being disposed in the friction seat grooved recesses. There is a set of friction shoes carried one each in the housing member friction bore friction shoe seats. These friction shoes have wear surfaces spaced apart by an radiused end with such shoe wear surfaces in contact, respectively, with the insert elongated segments and the shoe radiused ends positioned to engage the insert connecting segments. A wedge member is positioned between such set of friction shoes. This wedge member has sloped wedge surfaces engaging with the inside walls of such set of friction shoes. The final essential element of this friction type elastomer draft gear assembly is at least one resilient member which is engageable with at least one of such wedge member and such set of friction shoes. This resilient element exerts a predetermined lateral force on at least one of the wedge member and the set of friction shoes. Such lateral force being at least sufficient to maintain frictional engagement between the wedge member and such set of frictional shoes.

According to a final aspect of the present invention, a method of reconditioning a draft gear assembly is provided. Use of this method will restore such draft gear assembly to an AAR specified capacity in addition to providing a variable wedge angle capability to the draft gear assembly. Practice of this method includes removing all of the elements making up a friction cushioning mechanism from an open end of the draft gear housing member. Each of these elements are inspected for wear and other potential defects. As a result of this inspection, new elements are provided when required. At least one resilient member to provide the variable angle capability to the reconditioning draft gear assembly is selected. A determination is then made of where such at least resilient element should be installed and each of the elements are reinstalled within the open end of such housing member.

OBJECTS OF THE INVENTION

It is, therefore, one of the primary objects of the present invention to provide a draft gear assembly that will at least meet the AAR standards and which will provide a smoother performing friction clutch mechanism in the draft gear assembly during intrack service.

Another object of the present invention is to provide a draft gear assembly which utilizes a resilient member disposed in a position within such draft gear assembly to exert a lateral force on at least one friction component and preferably disposed between the inner surface of the housing member and an adjacent surface of at least one of the friction elements disposed closely adjacent such inner surface to achieve smoother operation of the friction clutch mechanism over the full range of travel of the draft gear assembly.

Still another object of the present invention is to provide a method of reconditioning a draft gear assembly to incorporate a resilient element in a position within such draft gear assembly to exert a predetermined lateral force on at least one friction component and preferably disposed between the inner surface of the housing member and an adjacent surface of at least one of the friction elements disposed closely adjacent such inner surface of the housing member.

Yet another object of the present invention is to provide a resilient element in a friction clutch mechanism of a draft gear assembly which ensures that all friction surfaces disposed on the various friction clutch elements will remain in contact after some predetermined amount of wear has occurred to these various friction clutch elements.

A further object of the present invention is to provide a resilient element in a friction clutch mechanism of a draft gear assembly to ensure such friction surfaces disposed on such various friction clutch elements remain in contact that is relatively inexpensive to manufacture.

An additional object of the present invention is to provide a resilient element in a friction clutch mechanism of a draft gear assembly to ensure such friction surfaces disposed on various friction elements remain in contact that is relatively easy to install and maintain.

Still yet another object of the present invention is to provide a resilient element in the friction clutch mechanism of a draft gear assembly that will provide a variable angle between at least one wedge member and a plurality wedge shoes at various stages of travel of the draft gear assembly.

These and various other objects and advantages of the draft gear assembly will become more readily apparent to those persons who are skilled in the railway rolling stock design art from the following more detailed description of the present invention, particularly, when such detailed description is taken in conjunction with both the attached drawings and with the appended claims.

DESCRIPTION OF THE VARIOUS EMBODIMENTS OF THE INVENTION

Figure 1:
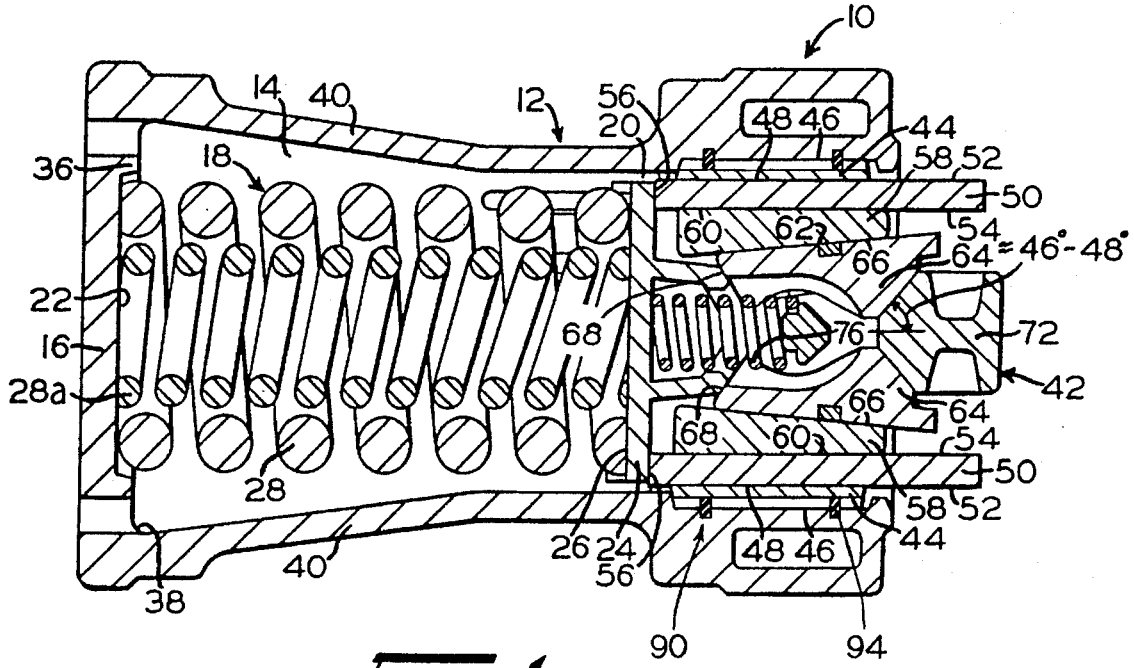
FIG. 1 is a longitudinal cross-sectional view incorporating one form of a presently preferred embodiment of the instant invention.

Prior to proceeding in the more detailed description of the instant invention, it should be noted that throughout the several views illustrated in the drawings, identical components having identical functions have been identified with identical reference numerals, for the sake of clarity.

The draft gear assembly, according to the present invention, is installed in alignment with a railroad car center sill member between a front and a rear draft gear lug. A vertically disposed yoke member is connected to a coupler shank by a draft key member with a coupler horn spaced from a striking plate and with a front follower member within the yoke member. The front follower member is positioned adjacent the front lugs. This arrangement is substantially in accordance with the conventional prior art practice as illustrated in the aforementioned U.S. Pat. No. 2,916,163.

Figure 2:
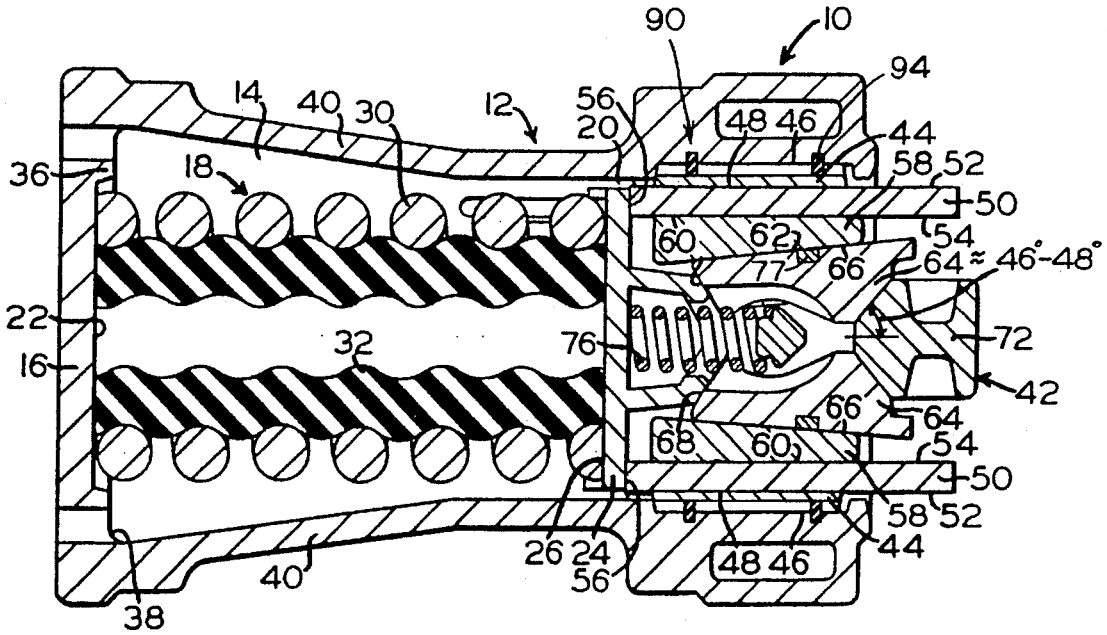
FIG. 2 is a longitudinal cross-sectional view incorporating an alternative embodiment of a compressible cushioning element of a presently preferred embodiment of the invention.
Figure 3:
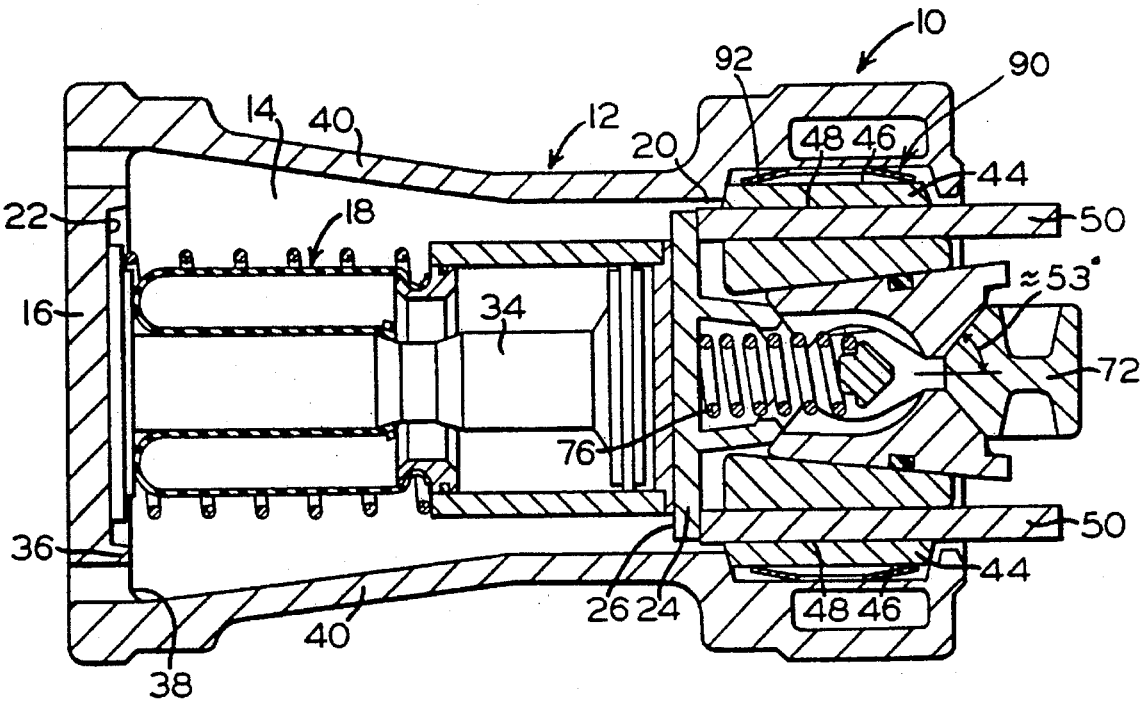
FIG. 3 is a longitudinal cross-sectional view of another alternative embodiment which incorporates a hydraulic cushioning element in a presently preferred embodiment of the invention.

Now referring more particularly to a first embodiment of the present invention, as illustrated in FIGS. 1–3, the draft gear assembly is generally designated as 10. Such draft gear assembly includes a generally hollow housing member, generally designated as 12. The housing member 12 is open at a first end thereof and has a rear portion 14 adjacent a bottom wall 16 which closes the opposed second end of hollow housing member 12. Rear portion 14 is provided for receiving therein a compressible cushioning means, generally designated as 18. The hollow housing member 12 includes a front portion 20 adjacent the open first end. Front portion 20 is in open communication with the rear portion 14.

The compressible cushioning element 18 is preferably substantially centrally disposed within the rear portion 14 of such hollow housing member 12 and has a first end thereof preferably abutting at least a portion of an inner surface 22 of the bottom wall 16 of the hollow housing member 12. The compressible cushioning element 18 extends longitudinally from the bottom wall 16 where the opposite second end is preferably placed into abutting relationship with at least a portion of one surface 26 of a seat means 24. Such seat means 24 is positioned within the hollow housing member 12 for longitudinal movement therein for, respectively, compressing and releasing the compressible cushioning element 18 during an application of and a release of a force being exerted on the draft gear assembly 10. A first predetermined portion of the energy generated by the compression of such draft gear assembly 10 is absorbed by the compressible cushioning element 18.

As shown in FIG. 1, the compressible cushioning element 18, according to one presently preferred embodiment of the invention, comprises at least one and preferably as least two springs 28. FIG. 2 shows another alternative embodiment for a compressible cushioning element 18 which comprises an outer coil spring 30 and an inner rubber spring 32. FIG. 3 shows still another alternative embodiment of the invention, in which the compressible cushioning element 18 is a hydraulic unit 34, such as taught in U.S. Pat. No. 3,447,693.

Preferably a compressible cushioning element 18 positioning means 36 is positioned within the second end adjacent the inner surface 22 of the bottom wall 16 of hollow housing member 12 for maintaining that end of the compressible cushioning element 18 substantially centrally located within the rear portion 14 of such hollow housing member 12 during compression and extension of such compressible cushioning element 18. According to one preferred embodiment of the invention, the positioning means 36 comprises a built-up portion 38 disposed in the hollow housing member 12 along two radially opposed sides adjacent the inner surface 22 of the bottom wall 16 and an inner surface of a connecting sidewall 40 of such hollow housing member 12.

A friction cushioning means, generally designated as 42, is positioned at least partially within the front portion 20 of the hollow housing member 12. The friction cushioning means 42 absorbs at least a second predetermined portion of the energy generated during an application of a force which is at least sufficient to cause at least some predetermined amount of compression of the draft gear assembly 10.

The friction cushioning means 42, in this embodiment of the invention, includes a pair of laterally spaced outer stationary plate members 44. Such outer stationary plate members 44 having an outer surface 46 and an opposed inner friction surface 48. In the preferred embodiment, at least a portion of the outer surface 46 engages a resilient member, generally designated 90, disposed between the inner surface of the hollow housing member 12 and such outer surface 46 of the outer stationary plate members 44. It should be understood, however, by those persons who are skilled in the draft gear art that it may be possible to position the resilient member 90 between a pair of other friction clutch components to achieve the same result.

The resilient member 90, depending upon the application, may be either a Bellville washer 92 or an elastomeric material 94. Such elastomeric material 94 may be Hytrel, for example, manufactured by Dupont. The resilient member 90, in any event, ensures that the friction surfaces of all of the friction clutch components remain in frictional engagement by virtue of the fact that it exerts a predetermined lateral pressure on such friction clutch components. One of the major advantages of the resilient member 90 is that it enables a variable angle to be provided between the wedge member 72 and wedge shoe members 64 at various stages of compression, thereby insuring improved efficiency of the friction clutch mechanism 42 during compression of the draft gear assembly 10.

A pair of laterally spaced movable plate members 50, of substantially uniform thickness, are also provided. Movable plate members 50 include an outer friction surface 52 and an inner friction surface 54 and at least one substantially flat edge 56 located intermediate the outer friction surface 52 and the inner friction surface 54. Such flat edge 56 is positioned to engage a portion of the seat means 24. At least a portion of a respective outer friction surface 52 of the movable plate members 50 movably and frictionally engages the inner friction surface 48 of a respective outer stationary plate member 44.

There is a pair of laterally spaced tapered plate members 58 provided. The tapered plate members 58 include an outer friction surface 60 and an inner friction surface 62. The outer friction surface 60 of a respective tapered plate member 58 movably and frictionally engages at least a portion of the inner surface 54 of a respective movable plate member 50.

Friction cushioning means 42 further includes a pair of laterally spaced wedge shoe members 64 which have at least a portion of an outer friction surface 66 movably and frictionally engaging at least a portion of the inner friction surface 62 of a respective tapered plate member 58. Wedge shoe members 64 have at least a portion of one edge 68 engaging a portion of the seat means 24 and a predetermined tapered portion 70 on an opposed edge thereof.

A center wedge member 72 is provided which has a pair of matching tapered portions 74 for engaging the tapered portion 70 of a respective wedge shoe member 64 to initiate frictional engagement of the friction cushioning means 42.

In the presently preferred embodiment, the tapered portions 70 of the wedge shoe members 64 and the tapered portions 74 of the center wedge member 72, which are tapered upwardly and outwardly from a plane intersecting the longitudinal centerline of the draft gear assembly 10, preferably should be controlled within a very close tolerance of between about 49° and 51°, and move preferably between about 49° and 50°, with the optimum of generally 50° when the compressible cushioning means 18 is either the springs 28 or the combination of a spring 30 and a rubber spring 32. Further, it is preferred that the taper be about 53° when such compressible cushioning element 18 is a hydraulic unit 34.

A spring release means 76 engages and extends longitudinally between the seat means 24 and the center wedge member 72 for continuously urging the friction cushioning mean 42 outwardly from the compressible cushioning means 18 to release the friction cushioning means 42 when an applied force compressing the draft gear assembly 10 is removed.

In operation, in this embodiment of the invention, the buffing shock is transmitted from the coupler through the front follower to the central wedge member 72, causing it to act through the wedge shoe members 64 and thereby compress all of the cushioning elements simultaneously. These elements will furnish sufficient cushioning for light buffing shocks. This is particularly the case in this invention because the resilient member 90 maintains all of the friction elements in frictional engagement. After suitable travel, however, the follower will come against the outer ends of the movable plate members 50 introducing energy-absorbing friction between the movable plate members 50 and the tapered stationary plate members 58 and the outer stationary plate members 44 which have been pressed together even tighter by the action of the wedge shoe member 64. As this action continues, the pressure between the adjacent friction surfaces of the intercalated plates has been enormously increased due to the fact that the wedge shoe members 64 are loaded against the cushioning mechanism 42. The energy absorption and dissipation through friction and compression of the cushioning mechanism 42 continues until the draft gear assembly 10 is closed including compression of the compressible cushioning element 18.

During release of the draft gear assembly 10, the second end of the compressible cushioning element 18 is maintained substantially in alignment by the seat means 24.

Figure 5:
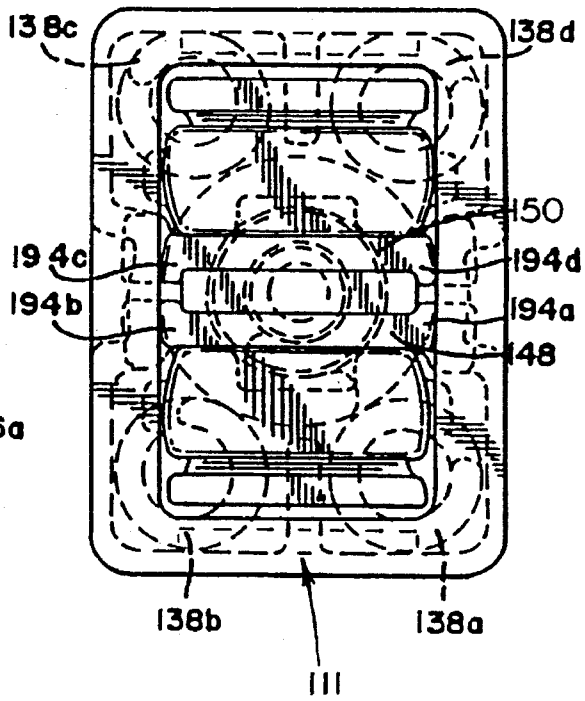
FIG. 5 is a top view of the draft gear assembly illustrated in FIG. 4.
Figure 4:
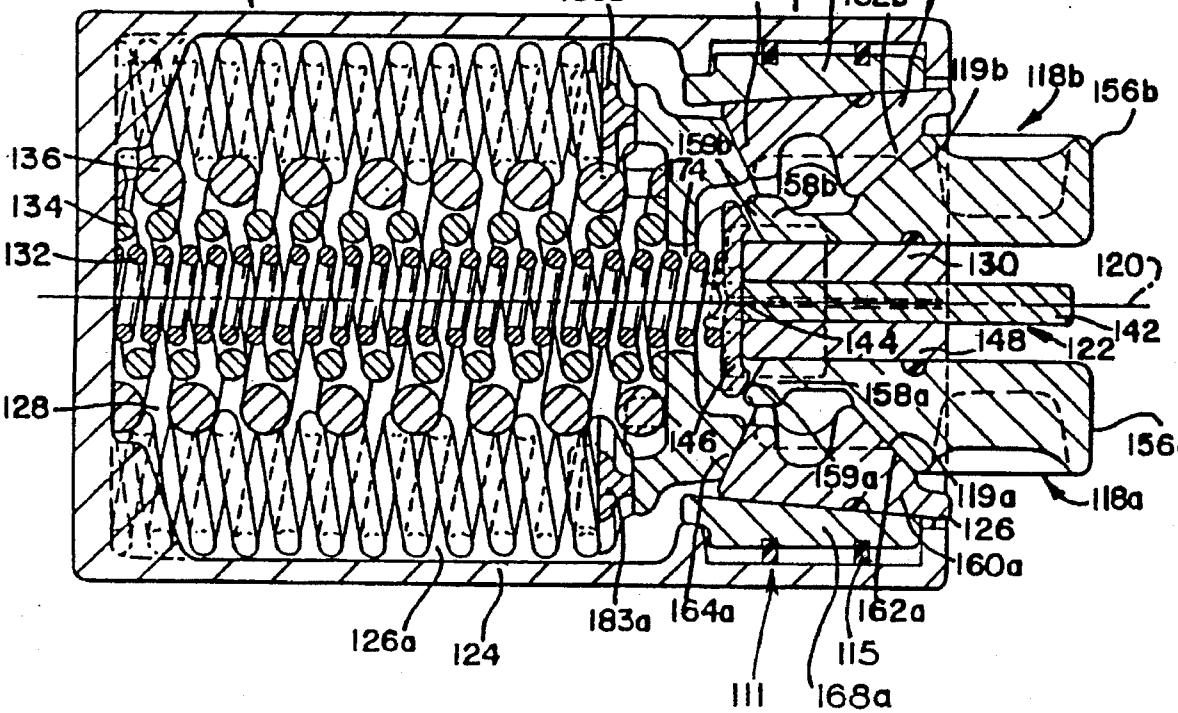
FIG. 4 is a side elevation view, partially in cross-section, illustrating still another alternative embodiment of the present invention.

As shown in FIGS. 4 and 5, there is an alternative embodiment of a draft gear assembly, generally designated 110, to which this invention applies. This draft gear assembly 110 includes a hollow housing member 124 having a generally tubular body with a first open end 126 and a second closed end or bottom wall 128. The major axis line 120 of draft gear assembly 110 being substantially centrally disposed along the length thereof.

A spring system 130 is disposed within the lower portion 126*a* of the hollow housing member 124 adjacent such second closed end 128. Spring system 130 includes an inner coil spring member 132, a middle coil spring member 134, an outer coil spring member 136 and first, second, third and fourth corner spring members 138*a*, 138*b*, 138*c*, and 138*d*.

A friction clutch mechanism, generally designated 140, is at least partially disposed within such first open end 126 and includes the following components. Firstly, the friction plate member 122, which is substantially centrally disposed along such major axis 120 having a first end 142 which extends outwardly from such hollow housing member 124 and a second end 144 which is shown in contact with the release wedge member 146.

Disposed one on either side of such friction plate member 122 are first and second barrier plate members designated 148 and 150. Each such barrier plate member 148 and 150 having first and second ends 154*a* and 154*b* being situated in the first open end 126 of hollow housing member 124 and second ends 152*a* and 152*b* adjacent the second end 144 of such friction plate member 122. It being understood that the first and second barrier plate members 148 and 150 are anchored against longitudinal movement with respect to the housing member 124 but are responsive to lateral pressures.

First and second frictional wedge members 118*a* and 118*b* are disposed one on either side of such barrier plate members 148 and 150 and have first ends 156*a* and 156*b* and second ends 158*a* and 158*b*. Such first ends 156*a* and 156*b* extending out from the hollow housing member 124 while such second ends 158*a* and 158*b* are situated adjacent such release wedge member 146. During operation, angled surfaces 159*a* and 159*b* of friction wedge members 118*a* and 118*b* cooperate with the angled surfaces 161*a* and 161*b* of such release wedge member 146.

First and second friction wedge shoe members 160*a* and 160*b* are disposed one on either side of such first and second friction wedge members 118*a* and 118*b*. Each having first angled portions 162*a* and 162*b* which cooperate with the angled portions 119*a* and 119*b* of such friction wedge members 118*a* and 118*b* and second angled portions 164*a* and 164*b* which cooperate with the angled portions 165*a* and 165*b* of the spring seat member 166.

First and second wear liner plate members 168*a* and 168*b* are disposed one on either side of such first and second friction shoe members 160*a* and 160*b*. Each such wear liner plate member 168*a* and 168*b* being anchored to the housing member 124 against longitudinal movement.

In this alternative embodiment of the draft gear assembly 110, there is preferably at least one resilient member, generally designated 111, disposed between an outer surface of at least one of the first and second wear liner plate members 168*a* and 168*b* and an adjacent inner surface of the housing member 124. The resilient member 111 may be carried by a groove formed in either the housing member 124 or a groove formed in the wear liner plate members 168*a* and 168*b*.

It should be understood, however, by those persons who are skilled in the draft gear art that it may be possible to position the resilient member 111 between at least one pair of other friction clutch components and accomplish the same end result.

The resilient member 111, depending upon the application, may be either a Bellville washer 113 or an elastomeric material 115. When the resilient member 111 is an elastomeric material 115, Hytrel, manufactured by Dupont, is the preferred elastomer. In any event, the resilient member 111 functions to insure that the friction surfaces of all of the friction elements remain in frictional engagement by virtue of the fact that it exerts a predetermined lateral pressure on the friction clutch components.

Another one of the significant advantages provided by the resilient member 111 is that it enables a variable angle to be provided between the wedge members 156*a* and 156*b* and the friction wedge shoe members 160*a* and 160*b* at various stages of compression. This variable angle provides improved efficiency of the friction clutch mechanism at least during compression of the draft gear assembly 110.

The release wedge member 146 includes a horizontally extending body portion 170 and first and second tapered end portions 161*a* and 161*b* which cooperate with the angled surfaces 159*a* and 159*b* of such friction wedge members 118*a* and 118*b* thereby defining an angle relationship with respect to the major axis 120.

The spring seat member 166 includes an aperture 174 located substantially in the center thereof and also includes angled surfaces 165*a* and 165*b*, which as previously stated are designed to cooperate with the angled end portions 164*a* and 164*b* of the friction wedge shoe members 160*a* and 160*b*. An angled relationship is thus defined with respect to such major axis or centerline 120 of draft gear assembly 110. The spring seat member 166 bears against the middle coil spring member 134 and the outer coil spring member 136 and against corner coil spring members 138*a*, 138*b*, 138*c*, and 138*d*, via the spring harness members 183*a* and 183*b*. The inner coil spring member 132 passes through the aperture 174 in the spring seat member 166 and bears directly against the release wedge member 146 whereby the angled portions 161*a* and 161*b* can be brought against the corresponding angled portions of the friction wedge members 159*a* and 159*b*.

As is apparent, the various angled surfaces define an angle, when a line passing therethrough is extended to the centerline 120 of the draft gear assembly 110 in this embodiment of the present invention.

During compression of the draft gear assembly 110 the friction wedge members 118*a* and 118*b*, which are always in contact with the follower plate, are pushed into the open end 126 of the hollow housing member 124. The friction wedge members 118*a* and 118*b* act upon the friction wedge shoe members 160*a* and 160*b* to wedge them against the wear liner plate members 168*a* and 168*b*. Thus, during the initial one half inch of compression which is an amount of movement common in normal train service, the friction plate member 122 is idle.

Frictional resistance is provided by the friction wedge members 156*a* and 156*b* and friction wedge shoe members 160*a* and 160*b* only, whereby the invention hereunder consideration makes use of four of its six frictional surfaces, these being first frictional surface 182, second frictional surface 184, third frictional surface 186 and fourth frictional surface 188, these four frictional surfaces being actuated during the initial one-half inch of travel of the friction wedge members 156*a* and 156*b*.

This results in a smoother draft gear assembly 110 with wear being spread over a greater number of parts and thus more evenly distributed among those parts subject to wear. Most importantly, because the friction wedge members 118*a* and 118*b* are spaced away from the major axis 120 of the draft gear assembly 110, they are able to compensate for compression forces which are not normal, After approximately one-half inch of travel of the friction wedge members 118*a* and 118*b*, the follower means contacts the centrally located friction plate member 122 and all three elements begin moving into the hollow housing member 124. As is apparent, this travel over one-half inch engages the last two of the six frictional surfaces, these being fifth frictional surface 192 and sixth frictional surface 194.

The wedging action of the friction wedge members 118*a* and 118*b* against the barrier plate members 148 and 150 results in the friction plate member 122 being squeezed therebetween as it is being forced into the hollow housing member 124. The two sides of the friction plate member 122, the flat back side of each friction wedge member 118*a* and 118*b* and the action of each friction wedge shoe member 162*a* and 162*b* against each wear liner plate member 168*a* and 168*b* provide for the total of six principal friction surfaces per draft gear assembly 110. As is apparent, these friction surfaces respectfully engage against and rub against both sides of each barrier plate member 148 and 150 and one side of each wear liner plate member 168*a* and 168*b*.

Four other frictional interfaces which are of lesser influence, although still important to over-all gear operation, includes those between the friction wedge members 118*a* and 118*b* and friction wedge shoe members 160*a* and 160*b* and those between the friction wedge shoe members 160*a* and 160*b* and spring seat member 166 contact surfaces.

During this time, the spring seat member 166 which always remains in contact with the corresponding friction wedge shoe members 160*a* and 160*b* is pushed by such friction wedge shoe members 160*a* and 160*b* toward the bottom wall of the hollow housing member 124. This results in the compression of the middle coil spring member 134, the outer coil spring member 136 and the four corner coil spring members 138. As is apparent the spring seat member 166 cooperates with the two spring harnesses holding the four corner coil spring members 138 in position. As was previously stated, the inner coil spring member 132 extends through the aperture 174 in the spring seat member 166 and is thus independent of any movement of such spring seat member 166.

It will be noted that after a slight compression movement of the friction wedge members 118*a* and 118*b* the release wedge member 146 is contacted by the angled portion thereof and they move as a unit thereafter. The inner coil spring member 132 is compressed by this movement of the release wedge member 146. The slightly greater travel of the spring seat member 166 for a given displacement of the friction wedge members 118*a* and 118*b* will result in the friction plate member 122 always being separate from and out-traveled by the spring seat member 166 during compression. The friction wedge members 118*a* and 118*b*, therefore, provide both spring force, and friction forces of resistance while the friction plate member 122 provides only frictional resistance.

When the compressive force from the draft gear assembly 110 is removed, the release sequence begins. At the beginning, to overcome initial static friction between the friction wedge members 118*a* and 118*b* and the barrier plate members 148 and 150, the release wedge member 146, due to the action of the inner coil spring member 132 and because of the various angled relationships between the friction components, breaks the tight surface contact. The friction wedge members 118*a* and 118*b* are then urged outwardly of the hollow housing member 124 by the friction wedge shoe members 160*a* and 160*b* with additional assistance from the independently spring loaded release wedge member 146. The returning spring seat member 166, in the mean time, picks up the friction plate member 122 and returns it to its initial position. The friction wedge shoe members 160*a* and 160*b* are also returned by the spring seat member 166 and simultaneously push the friction wedge members 118*a* and 118*b*.

Figure 9:
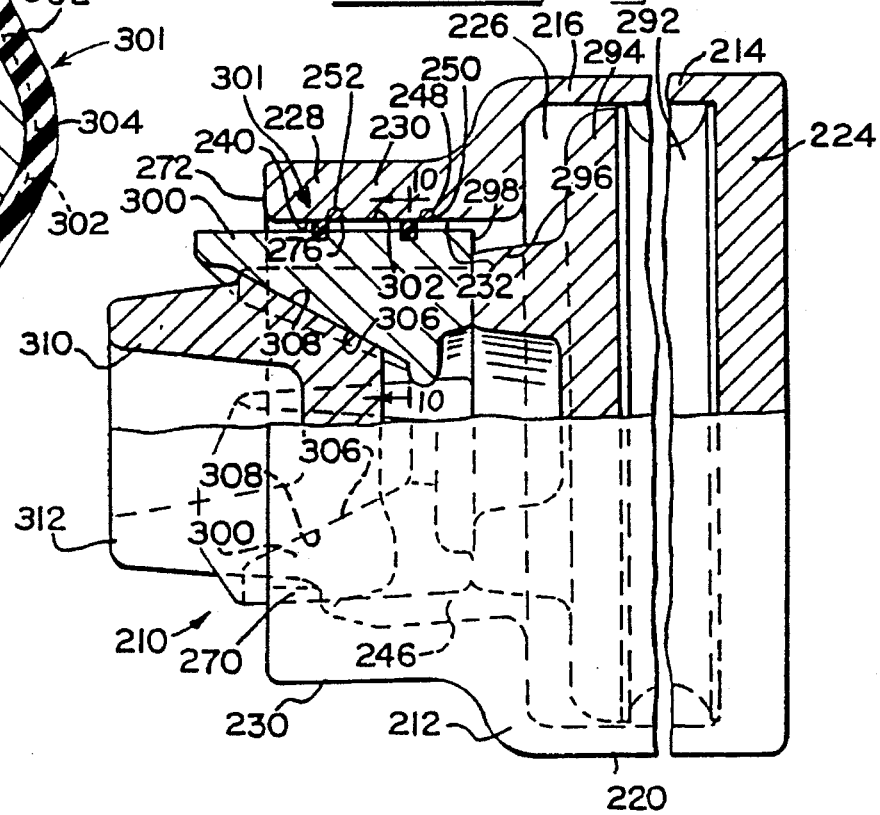
FIG. 9 a side elevation view, partially in cross-section, of an assembled draft gear incorporating the present invention.

Another alternative embodiment of an assembled draft gear assembly for a railroad car coupler system is shown generally in FIG. 9 and designated as 210. As is understood by those familiar with this art, the draft gear assembly 210 is typically carried in a yoke (not shown) which in turn attaches to a center sill member (not shown) of a railroad car body (not shown).

Figure 6:
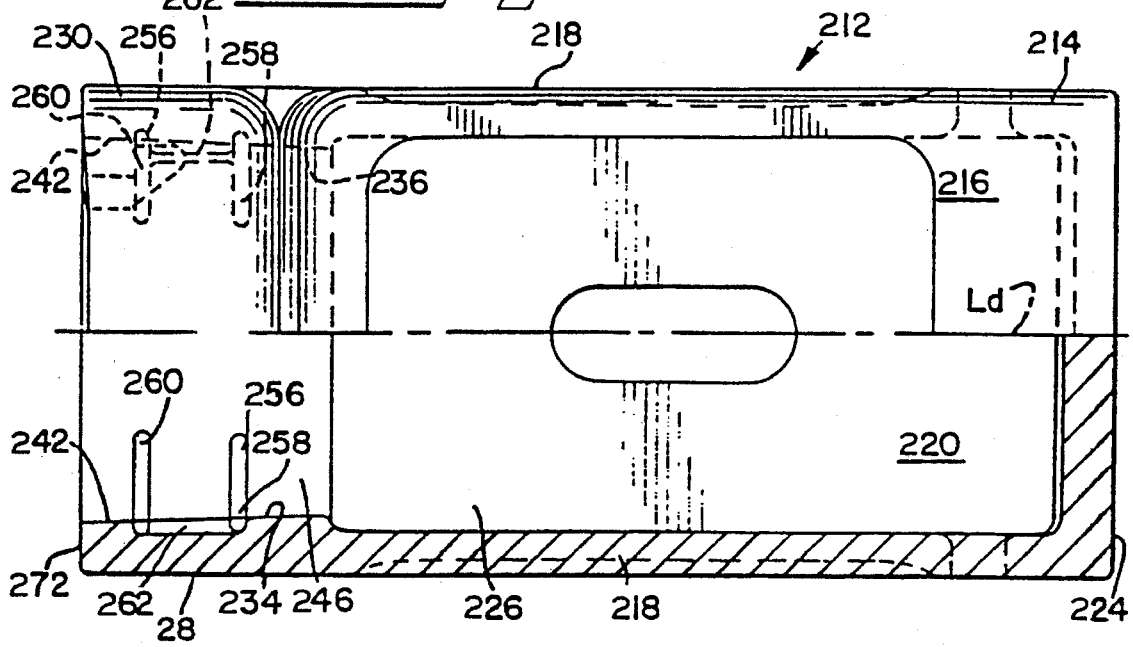
FIG. 6 is a plan view, partially in cross-section, of a draft gear housing of another style draft gear to which the present invention is applied.
Figure 7:
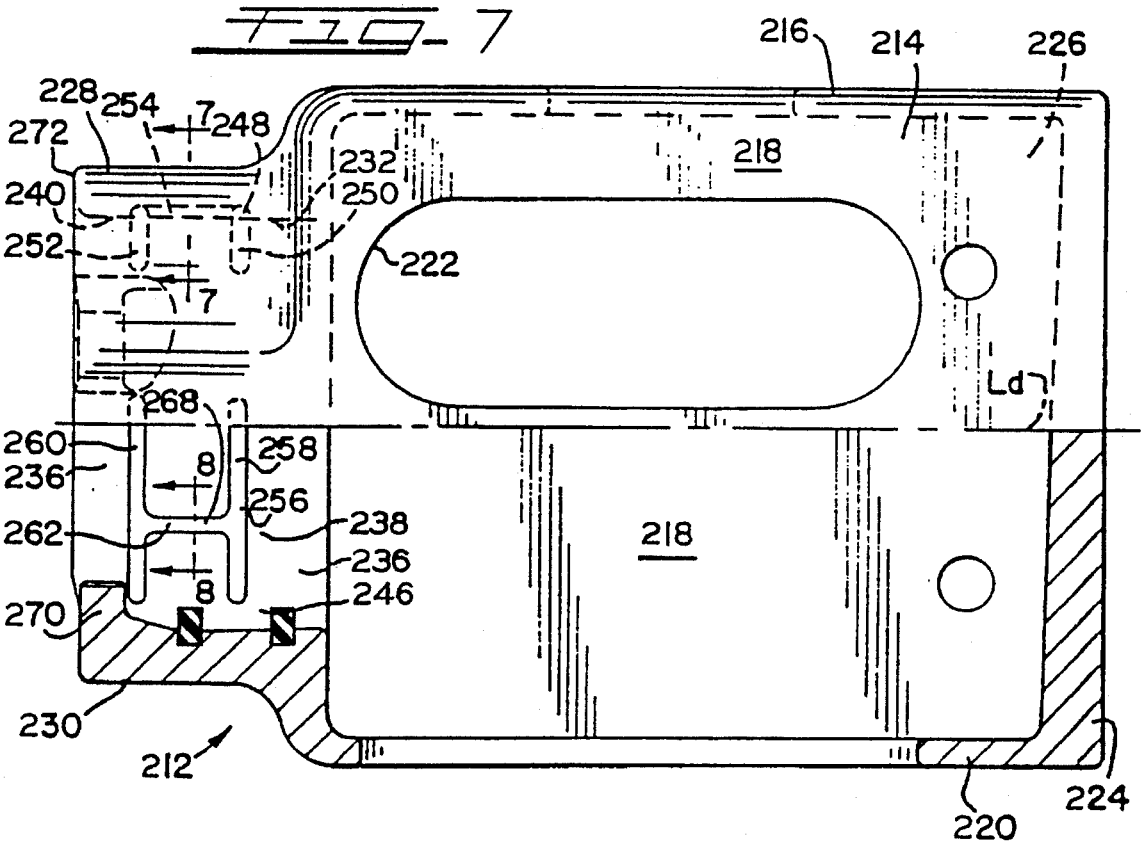
FIG. 7 is a side elevation view, also partially in cross-section, of the housing illustrated in FIG. 6.
Figure 8:
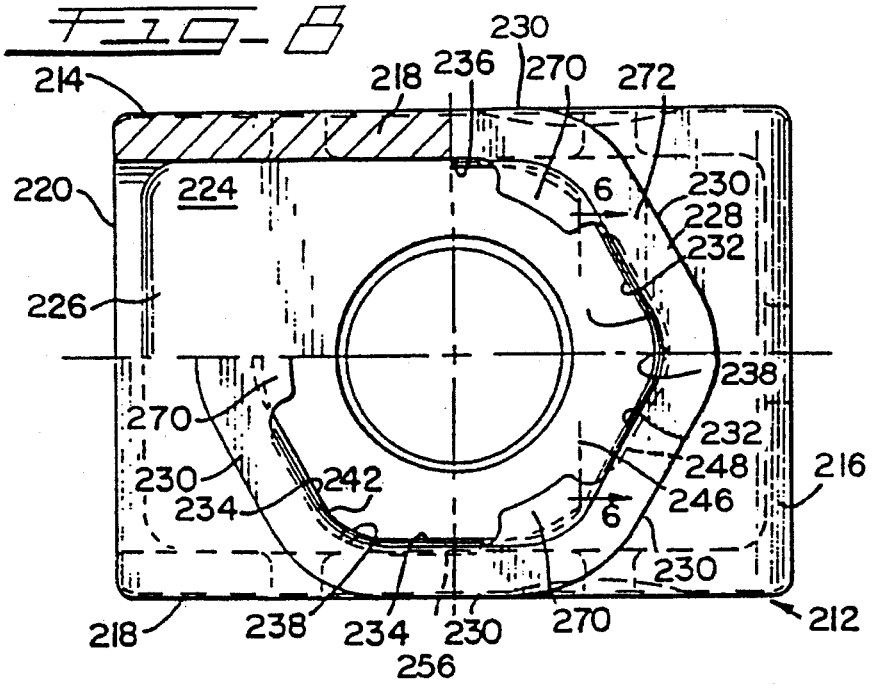
FIG. 8 is a front elevation view, with a cutaway portion in section, of the housing of FIG. 7, in this view the housing is rotated 90 degrees clockwise to show it on its right side, as such position is actually used in the coupler yoke.

A hollow housing member 212 of the draft gear assembly 210 is shown in detail in FIGS. 6, 7 and 8. The hollow housing member 212 has an inner section 214 defined by a top wall 216, spaced apart sidewalls 218, and a bottom wall member 220. The hollow housing member 212 is cast and may include a number of weight reducing openings, for example, an opening 222 in each sidewall 218. Such openings 222 also facilitate removal of the core of the hollow housing member 212 as cast. Additionally, the housing inner section 214 includes an inner end wall 224 to complete a closure to an inner space 226.

Connecting with the housing inner section 214 is an outer friction bore section 228. The friction bore section 228 is defined by sidewalls 230 set in a hexagon array. Pairs of adjacent sidewall inner surfaces 232, 234, and 236 join with a 320 degree radiused corner 238, see FIG. 8, to form a top friction shoe seat 240 and two side friction shoe seats 242. These seats 240, 242 define a friction bore section inner space 246.

Figure 11:
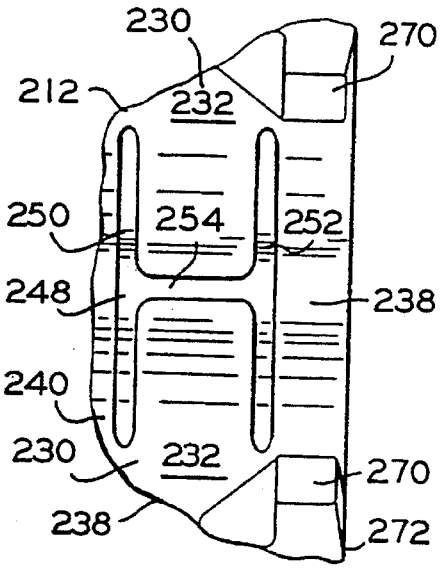
FIG. 11 is a detailed view of a portion of a friction shoe section as seen generally along the line 6—6 of FIG. 8 showing a grooved recess therein.

In the top friction shoe seat 240 is a top H-shaped grooved recess 248, see FIG. 11. The top grooved recess 248 is defined by an inner groove portion 250 and an outer groove portion 252 joined by a connecting groove portion 254. The cross sectional configuration of the top connecting groove portion 254 is shown with the configuration of the groove portions 250, 252, being substantially the same.

In each side friction shoe seat 242 is a further H-shaped grooved recess 256, each likewise defined by an inner and outer grooved portion 258, 260, and a connecting groove portion 262. As seen, a lower wall 264 of the connecting groove portion 262 is substantially horizontal while an upper wall 266 is positioned on an angle approximately 30 degrees above the horizontal. This positioning of the lower and upper walls 264, 266 forms an enlarged opening 268 to each connecting groove portion 262 of the side grooved recesses 256.

Note that the connecting groove portions 254, 262 are positioned to align with the corners 238. This alignment places the inner and outer groove portions 250, 252, and 258, 260 perpendicular to a longitudinal axis Ld of the hollow housing member 212 and the connecting groove portions 254, 262 parallel thereto. As so positioned, the grooved recesses 248, 256, are located between and inward from three spaced lugs 270 extending into the friction bore inner space 246 at a front wall 272 of such.

As was noted earlier, the assembled draft gear assembly 210 is shown in FIG. 9 and includes a spring package. The spring package, in this embodiment of the invention, includes a number of elastomeric pads 292 located in the inner space 226 of the hollow housing member 212 between the end wall 224 and a movable intermediate follower 294. An outer end 296 of the follower 294 extends into the housing friction bore inner space 246 to engage an inner wall 298 of three friction shoe members 300.

Figure 10:
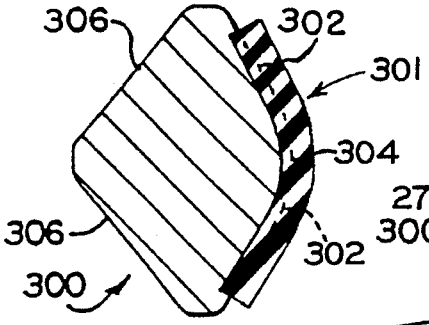
FIG. 10 is a cross sectional view of one of the friction shoes of the assembled draft gear as seen generally along the line 5—5, in FIG. 9.

Each friction shoe member 300 has a pair of angularly positioned wear surfaces 302, best seen in FIG. 10. These wear surfaces 302 joined a lait end 304. One each of the friction shoe members 300 is located in the top and side friction shoe seats 240, 242, preferably such that the friction shoe wear surfaces 302 are in contact with the friction bore section sidewall inner surfaces 232, 234, and 236 respectively. This arrangement places the friction shoe members 300 wear surfaces 302 in contact with the flat inner surface 286 of the insert segments 278. The lait ends 304 of the friction shoe members 300 in turn are positioned in the corners 238 and thus prepared for contact with the connecting segments 284 of the inserts 276.

Each friction shoe member 300 further has an inwardly sloped inside wall 306. These inside walls 306 of the friction shoe members 300 in turn are in contact with complimentarily formed sloped wedging surfaces 308 of a wedge member 310. An outer end 312 of the wedge member 310 extends outwardly from and beyond the front wall 272 of the housing friction bore section 228. The outer end 312 of the gear wedge member 310 typically is in contact with a follower (not shown) of the railroad car coupler system. This follower engages an inner end of a shank having an outer coupler head end for joinder with an adjacent coupler head end of another railroad car.

In the draft gear assembly 210, of this embodiment, at least a portion of the outer surfaces of the friction wedge shoe members 300 engages at least one resilient member, generally designated 301, disposed between the inner surface of the hollow housing member 314 and such outer surface of the friction wedge shoe members 300. The resilient member 301 may be either a Bellville washer or an elastomeric material. When an elastomeric material is used it will preferably be Hytrel, as manufactured by Dupont. The resilient member 301 is provided to insure that the friction elements will remain in frictional engagement because it exerts a predetermined lateral pressure on the friction clutch components. This provides the significant advantage that the resilient member 301 enables a variable angle to exist between the wedge member 310 and the friction shoe members 300. Such variable angle provides improved efficiency of the friction clutch during compression of the draft gear assembly 210.

As was briefly noted earlier, the draft gear housing 214 is made using casting techniques. A core having an exterior surface complementary to an interior surface of the hollow housing member 214 is placed in a mold having an interior surface complementary to an exterior surface of the hollow housing member 214. The housing core is made in a core box having an interior surface substantially the same as the interior surface of the hollow housing member 214. Thus, the core box also is formed with a top and side grooved recesses similar to the top and side grooved recesses 248, 256 of the hollow housing member 214. To utilize high production casting techniques a parting line between core box portions is aligned with the connecting groove portion of the top grooved recess of the core. After the core is formed, the enlarged openings to the connecting groove portions of the side grooved recesses as provided by the angularity between the lower and upper walls of such allow the core box portions to simply be drawn away at approximately a right angle from the formed core.

During operation, the coupler system is subjected to impacting forces. These forces may be in an inward direction, i.e., buff or in an outward direction, i.e., draft. The coupler system is subjected to buffing forces when coupling of two railroad cars occurs, for example, the coupler heads of each railroad car collide at a speed sometimes in excess of 5 m.p.h. The coupler system is placed in draft when the railroad car is drawn forward from a standing position, for example.

To prevent these impacting forces from causing structural damage to the coupler system or other portions of the railroad car, the draft gear assembly 210 acts to absorb and cushion the shock of these forces. For example, when a buffing force is applied, the wedge member 310 of the draft gear assembly 210 is driven inward. The sloped surfaces 308 of the wedge member 310 in turn force the friction shoe members 300 inward as well as radially outward. The radial outward movement is limited by contact between the friction shoes wear surfaces 302 and the sidewalls 230 of the friction bore friction shoe seats 340, 342. The inward movement of the friction shoe members 300 is first restrained by friction between the friction shoe wear surfaces 302 and the friction shoe seat 340, 342. The magnitude of this restraining force is equal to the product of the coefficient of friction between these surfaces and the amount of force placed on the friction shoe members 300 by the wedge member 310 in a direction normal to the direction of the friction shoe member 300 movement. Additionally, inward friction shoe member 300 movement is resisted by the elastomeric pads 292 of the spring package which are compressed as the friction shoe members 300 move the intermediate follower 294 toward the housing end wall 224.

Note that the friction shoe members 300 can move inward a distance sufficient to expose the insert segments 278 in the outer groove portions 252, 260. A portion of the insert connecting segments 284 and other parallel segments 278 in the inner groove portions 250, 258 remain in contact with the friction shoe members 300. The rigidity of the inserts 276 insures that the exposed segments 278 remain in their respective outer groove portions 252, 260.

During this friction shoe member 300 movement the shoe wear surfaces 302 also interact with the flat inner surfaces 286 of the inserts 276. A film of insert material wipes on to the shoe wear surfaces 302 to provide a lubricating interface between the friction shoe members 300 and the friction shoe seats 240, 242. This lubricant regulates the coefficient of friction to maintain such at a near uniform level thereby increasing the useful life of the friction shoe members 300 as well promoting uniform operative shoe action. The friction shoe members 300 not only move inward against a uniform frictional restraint, but they may then also move outward to return the wedge member 310 to engage the lugs 270 once the impacting force has been absorbed. Structural damage to the coupler system could then occur.

As the wear surfaces 302 of the friction shoe members 300 are depleted, the friction shoe members 300 move radially outward. This outward shoe movement presses the shoe lait ends 304 into a tighter fit with the friction shoe seat lait corners 238 respectively. As the tightness of this fit increase, the probability of shoe lockup also increases. Note, however, that the shoe lait end 304 comes into contact with the insert connecting segment 284. The insert connecting segment 284 provides a film of lubricant therebetween as well as an area of softness to inhibit shoe lockup if the friction shoe member 300 becomes misaligned. Thus, the elastomeric pads 292, friction shoe members 300 and wedge member 310 are inhibited from being stuck in an inward pressed position.

The present invention further provides a method of reconditioning a draft gear assembly to both restore such draft gear assembly to an AAR specified minimum capacity and at the same time provide a variable wedge angle capability to the draft gear assembly. In this method all of the elements forming a part of the friction cushioning mechanism portion of such draft gear assembly are removed from the open end of the housing member. Each of the elements removed are inspected for wear and/or other potential defects such as cracks etc. When one of the elements is found to have excessive wear or some other defect a new element is used in it's place in restoring and providing the variable wedge angle capability to the draft gear assembly. The method includes selecting a resilient member which, when installed will insure that all friction surfaces of the friction cushioning mechanism will remain in frictional engagement in addition to providing such variable wedge angle capability. A determination is made where to position the resilient member prior to reinstalling each of the elements within the open end of the housing member, thereby providing a reconditioned draft gear assembly.

Preferably, there will be at least two resilient members provided in the reconditioning process which will be selected from the group consisting of an elastomer and a Bellville washer. When an elastomer is selected it will preferably be Hytrel, as manufactured by Dupont.

While a number of presently preferred and alternative embodiments of the draft gear assembly according to the present invention have been described in considerable detail above, it should be understood that various other modifications and adaptations of the instant invention can be made by those persons who are skilled in the railway draft gear art without departing from the spirit and scope of the appended claims.

We claim:

1. A variable angle draft gear assembly to cushion buff and draft shocks encountered in railroad rolling stock during operation, said variable angle draft gear assembly comprising:

(a) a hollow housing member open at a first end thereof and closed at an opposed second end thereof, said hollow housing member having a rear portion adjacent said closed second end and a front portion adjacent said opposed first open end, said front portion being in open communication with said rear portion;

(b) at least one coil spring and one rubber spring joined to comprise a compressible cushioning element substantially centrally disposed within said rear portion of said hollow housing member, said compressible cushioning element having a first end and a second end, said second end disposed adjacent at least a portion of an inner surface of said closed second end of said hollow housing member, said compressible cushioning element extending longitudinally from said closed second end, said compressible cushioning element absorbing a first portion of energy generated during compression of said variable angle draft gear assembly;

(c) a seat means having at least a portion of one surface thereof disposed adjacent said first end of said compressible cushioning element and mounted to move longitudinally within said hollow housing member for, respectively, compressing and releasing said compressible cushioning element during an application and a release of a force being exerted on said variable angle draft gear assembly;

(d) a friction cushioning means positioned at least partially within said front portion of said hollow housing member for absorbing a second portion of such energy generated during a compression of said variable angle draft gear assembly, said friction cushioning means including;

(i) a pair of laterally spaced outer stationary plate members having an outer surface and an opposed inner friction surface, said outer surface disposed adjacent an inner surface of said hollow housing member at said opposed second open end thereof, (ii) a pair of laterally spaced movable plate members of substantially uniform thickness and having an outer friction surface and an inner friction surface and at least one substantially flat edge portion disposed intermediate said outer friction surface and said inner friction surface, said one flat edge portion of each of said pair of laterally spaced movable plate members engaging a portion of said seat means, at least a portion of said outer friction surface movably and frictionally engaging said inner friction surface of a respective one of said outer stationary plate members, (iii) a pair of laterally spaced tapered plate members having an outer friction surface and an inner friction surface, said outer friction surface movably and frictionally engaging at least a portion of said inner friction surface of a respective one of said movable plate members, (iv) a pair of laterally spaced wedge shoe members having at least a portion of an outer friction surface movably and frictionally engaging at least a portion of an inner friction surface of a respective one of said tapered plate members and at least a portion of one edge engaging another portion of said seat means, each of said pair of wedge shoe members having a predetermined tapered portion which is tapered upwardly and outwardly from a plane intersecting a longitudinal centerline of said variable angle draft gear assembly at a predetermined angle, and (v) a center wedge member having a pair of matching predetermined tapered portions for engaging said tapered portion of a respective one of said wedge shoe members to initiate frictional engagement of said friction cushioning means and thereby absorb said second portion of such energy generated by buff and draft loads being exerted on said variable angle draft gear assembly;

(e) a spring release means longitudinally extending between said seat means and said center wedge member for continuously urging said friction cushioning means outwardly from said compressible cushioning element to release said friction cushioning means when an applied force compressing said variable angle draft gear assembly is removed; and (f) at least one resilient member having a portion received in at least one groove formed on at least one inner surface of said housing member adjacent said first open end thereof, said groove having substantially a shape of said portion, and said at least one resilient member engaged with at least one of said outer stationary plate members for exerting a predetermined lateral force on said friction cushioning means which is at least sufficient to maintain all of said friction surfaces in frictional engagement even when a predetermined amount of wear has occurred to at least one of said members.

2. A variable angle draft gear assembly, according to claim 1, wherein said at least one coil spring of said compressible cushioning element is concentrically disposed about said at least one rubber spring of said compressible cushioning element.

3. A variable angle draft gear assembly, according to claim 1, wherein said at least one resilient member is one of an elastomer and a Bellville washer.

4. A variable angle draft gear assembly, according to claim 3, wherein said at least one resilient member is an elastomer.

5. A variable angle draft gear assembly, according to claim 1, wherein said variable angle draft gear assembly further includes a positioning means disposed on said inner surface of said closed end of said housing member for maintaining said second end of said compressible cushioning element substantially centrally positioned in said rear portion of said housing member during compression and extension of said compressible cushioning element.

6. A variable angle draft gear assembly, according to claim 3, wherein said variable angle draft gear assembly includes a pair of resilient members.

7. A variable angle draft gear assembly, according to claim 6, wherein said pair of resilient members are an elastomer.

8. A variable angle draft gear assembly, according to claim 3, wherein said variable angle draft gear assembly includes a pair of resilient members, one of said resilient members being disposed between an outer surface of a first one of said outer stationary plate members and an adjacent inner surface of said hollow housing member, and a second one of said resilient members being disposed between an outer surface of a second one of said outer stationary plate members and an adjacent inner surface of said hollow housing member.

9. A friction elastomer variable angle draft gear assembly, according to claim 8, wherein each of said resilient members is one of an elastomer and a Bellville washer.

* * * * *

UNITED STATES PATENT AND TRADEMARK OFFICE

CERTIFICATE OF CORRECTION

PATENT NO. : 5,529,194

DATED : JUNE 25, 1996

INVENTOR(S) : WALTER H. MERKER, JR. et al.

It is certified that error appears in the above-indentified patent and that said Letters Patent is hereby corrected as shown below:

Column 4, line 29, please delete "-".
Column 4, line 47, after "with", please insert --the--.
Column 4, line 56, after "aspect", please insert --,--.
Column 5, line 61, after "members.", please start new paragraph.

Column 6, line 60, please delete "intrack", and insert --in-track--.

Column 8, line 34, after "assembly", please insert --10--.

Column 11, line 33, please delete "161b", and insert --161b--.
Column 12, line 13, please delete "161b", and insert --161b--.
Column 12, line 31, please delete "161b", and insert --161b--.
Column 12, line 64, please delete ",", and insert --.--.

Signed and Sealed this

Twenty-seventh Day of January, 1998

*Attest:*

*Attesting Officer*

BRUCE LEHMAN

*Commissioner of Patents and Trademarks*